US006905425B2

(12) United States Patent
Sasaki et al.

(10) Patent No.: US 6,905,425 B2
(45) **Date of Patent: *Jun. 14, 2005**

(54) GOLF BALL

(75) Inventors: Takashi Sasaki, Kobe (JP); Akira Kato, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/907,664

(22) Filed: Jul. 19, 2001

(65) Prior Publication Data

US 2002/0034991 A1 Mar. 21, 2002

(30) Foreign Application Priority Data

Jul. 19, 2000 (JP) ..... 2000-218931
May 24, 2001 (JP) ..... 2001-155398

(51) Int. Cl.[7] ..... A63B 37/04; A63B 37/06; A63B 37/12; A63B 37/14

(52) U.S. Cl. ..... 473/378; 473/371

(58) Field of Search ..... 473/351–378; 525/93, 94

(56) References Cited

U.S. PATENT DOCUMENTS

| | | | | |
|---|---|---|---|---|
| 4,884,814 A | | 12/1989 | Sullivan | |
| 5,120,791 A | | 6/1992 | Sullivan | |
| 5,948,862 A | * | 9/1999 | Sano et al. | 473/373 |
| 6,251,030 B1 | * | 6/2001 | Kato et al. | 473/365 |
| 6,334,820 B1 | * | 1/2002 | Sasaki | 473/374 |
| 6,359,065 B1 | * | 3/2002 | Yabuki | 525/71 |
| 6,359,066 B1 | * | 3/2002 | Yabuki | 525/71 |
| 6,576,707 B2 | * | 6/2003 | Ohama et al. | 525/93 |
| 2003/0064828 A1 | * | 4/2003 | Kato | 473/374 |

FOREIGN PATENT DOCUMENTS

| | | |
|---|---|---|
| GB | A2264302 | 8/1993 |
| GB | A2278364 | 11/1994 |
| GB | A2311530 | 1/1997 |
| JP | A06299052 | 10/1994 |
| JP | A08000767 | 9/1996 |
| JP | 09-308708 | 2/1997 |
| JP | 10/201881 | 4/1998 |
| JP | A10179802 | 7/1998 |
| JP | 10-179802 | 7/1998 |

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

A golf ball is provided that is soft and thus provides an excellent shot feeling, the golf ball exhibiting less deterioration in impact resilience and a superior spin characteristic. The golf ball is further superior in burr resistance and scuff resistance when being shot by an iron club. The golf ball is formed of a core and a cover surrounding the core and the cover composition contains a polymer component including 10 to 80 parts by weight of an ethylene-(meth)acrylic acid copolymer-based ionomer resin (Component A), 0 to 60 parts by weight of an ethylene-(meth)acrylic acid-(meth) acrylic acid ester ternary copolymer-based ionomer resin (Component B), and 5 to 60 parts by weight of a thermoplastic elastomer containing a styrene block (Component C). The cover composition has a shore D hardness of 40 to 60.

11 Claims, No Drawings

GOLF BALL

BACKGROUND OF THE INVENTION

1. Field of the Invention

The present invention relates to a golf ball superior in shot feeling, impact resilience, controllability and scuff resistance as a whole.

2. Description of the Background Art

As a resin component of a cover material for two-piece golf balls and thread-wound golf balls, an ionomer resin of an ethylene-(meth)acrylic acid copolymer has widely been employed because of its superior durability with respect to shot and cut resistance. However, the ionomer resin provides "hard feel" when being shot as compared with balata rubber having been used for cover materials, and the ionomer resin has a higher hardness than balata rubber. Therefore, it is difficult to apply a spin to a ball covered with the ionomer resin and thus the ionomer resin is inferior in controllability.

Balata covered golf balls have widely been used typically by skilled and professional golfers because of its excellent shot feeling and controllability. However, such balata covered golf balls are produced through a complicated manufacturing process and have an inferior cut resistance. Then, various soft covers are proposed these days as a substitute for the balata cover.

For example, U.S. Pat. No. 4,884,814 discloses a technique of using a soft ionomer resin as a base resin for a cover. Specifically, an ethylene-(meth)acrylic acid-(meth) acrylic acid ester terpolymer, which is a relatively flexible ionomer resin, is blended, at a certain ratio, with an ionomer resin of an ethylene-(meth)acrylic acid copolymer in a certain range of physical properties, and the blended ionomers are used to form a soft/hard ionomer-blended cover. This technique overcomes the disadvantages with respect to shot feeling and controllability of conventional golf balls having covers of an ionomer resin of an ethylene-(meth) acrylic acid copolymer.

The soft/hard ionomer-blended cover of the above technique is made softer and thus a spin is readily applied to a golf ball with this cover in an iron shot, while friction increases between a club face and the cover. When a golf ball like a two-piece solid golf ball having a hard core material is shot, the surface of the cover is chipped off by grooves of an iron club so that the surface of the ball is burred. The lower hardness of the ionomer cover reduces the impact resilience of the cover itself, resulting in deterioration in impact resilience of the ball.

In GB 2264302, it is proposed, for the purpose of improving resistance to abrasion of the ionomer cover caused by shot by the iron club, to use, as a cover, at least two types of materials made from metal salt of ethylene-unsaturated carboxylic acid-unsaturated carboxylic acid ester terpolymer having low flexural modulus. However, this technique is insufficient with respect to scuff resistance when the golf ball is struck with the iron club as described above and has a deteriorated impact resilience.

Japanese Patent Laying-Open No. 10-179802 proposes a golf ball having a base resin material for a cover structured to have as a main component a heated mixture of two components, that is, an ionomer resin and a styrene-butadiene-styrene block copolymer containing an epoxy group or a styrene-isoprene-styrene block copolymer containing an epoxy group. A cover composition constituting the cover has a flexural modulus of 50 to 300 MPa and a shore D hardness of 40 to 60.

Further, GB 2311530 proposes a golf ball having a base resin material for a cover that has as a main component a heated mixture of three components, that is, ionomer resin, acid-modified thermoplastic elastomer or thermoplastic elastomer having an OH group at the end of the polymer chain, and a styrene-butadiene-styrene block copolymer containing an epoxy group or a styrene-isoprene-styrene block copolymer containing an epoxy group. A cover composition constituting the cover has a flexural modulus of 50 to 300 MPa and a shore D hardness of 40 to 60.

These techniques achieve improvement in shot feeling, controllability and cut resistance, however, they are unsatisfactory in terms of impact resilience.

SUMMARY OF THE INVENTION

One object of the present invention is to provide a golf ball that is soft and thus provides a superior shot feeling, exhibiting less deterioration in impact resilience, a superior spin characteristic (controllability), and superior resistance to burr and abrasion when the golf ball is hit by an iron club.

The present invention is a golf ball formed of a core and a cover surrounding the core, the cover formed of a cover composition containing a polymer component including 10 to 80 parts by weight of an ethylene-(meth)acrylic acid copolymer-based ionomer resin (Component A), 0 to 60 parts by weight of an ethylene-(meth)acrylic acid-(meth) acrylic acid ester ternary copolymer-based ionomer resin (Component B), and 5 to 60 parts by weight of a thermoplastic elastomer containing a styrene block (Component C), and the cover composition having a shore D hardness of 40 to 60.

The thermoplastic elastomer containing the styrene block (Component C) can be a styrene-butadiene-styrene block copolymer (SBS), styrene-isoprene-styrene block copolymer (SIS), styrene-isoprene-butadiene-styrene block copolymer (SIBS), or hydrogenated copolymers of respective copolymers. In other words, the thermoplastic elastomer containing the styrene block (Component C) can be an SBS, hydrogenated SBS, SIS, hydrogenated SIS, SIBS, or hydrogenated SIBS. As the hydrogenated SBS, for example, a styrene-ethylene-butylene-styrene block copolymer (SEBS) can be used. As the hydrogenated SIS, for example, a styrene-ethylene-propylene-styrene block copolymer (SEPS) can be used. As the hydrogenated SIBS, for example, a styrene-ethylene-ethylene-propylene-styrene block copolymer (SEEPS) can be used.

The thermoplastic elastomer containing the styrene block (Component C) can be a styrene-butadiene-styrene block copolymer (SBS), hydrogenated SBS, styrene-isoprene-styrene block copolymer (SIS), hydrogenated SIS, styrene-isoprene-butadiene-styrene block copolymer (SIBS), hydrogenated SIBS, or a polymer alloy formed of a polyolefin. Here, the polymer alloy is either a blend of a block copolymer such as SBS and the like described above and a polyolefin, or a polymer including the block copolymer as described above and the polyolefin as constituents of the polymer chain.

Preferably, the thermoplastic elastomer containing the styrene block has a shore A hardness of at most 95.

Still preferably, according to the present invention, the ethylene-(meth)acrylic acid copolymer-based ionomer resin (Component A) has a shore D hardness of 55 to 70 and a flexural modulus of 200 to 500 MPa, the ethylene-(meth) acrylic acid-(meth)acrylic acid ester ternary copolymer-based ionomer resin (Component B) has a shore D hardness of 30 to 55 and a flexural modulus of 10 to 100 MPa, and the thermoplastic elastomer containing the styrene block has a shore A hardness of at most 95.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

According to the present invention, a golf ball has a cover composition including Component A which is an ethylene-acrylic acid copolymer ionomer resin and/or an ethylene-methacrylic acid copolymer ionomer resin. Preferably, the composition ratio of an ethylene and an acrylic acid or methacrylic acid constituting the copolymer is that the ethylene is 70 to 95% by weight and the acrylic acid or methacrylic acid is 5 to 30% by weight. It is noted that the ionomer is partially neutralized with a metal salt and cross-linked with a metal ion. Examples of the metal ion are sodium ion, lithium ion, zinc ion, magnesium ion, potassium ion and the like.

The ionomer resin is the copolymer of the ethylene and the acrylic acid or methacrylic acid having a carboxyl group which is at least partially neutralized and cross-linked with a metal ion, the ionomer resin has a shore D hardness of 55 to 70 and a flexural modulus of 200 to 500 MPa, and thus the ionomer resin is of so-called high-rigidity type.

Specifically, the ionomer resin described above is commercially available from DuPont-Mitsui Polychemicals Co., Ltd. as those products under the trade names of Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan AM7315 (Zn), Hi-milan AM7317 (Zn), Hi-milan AM7311 (Mg), Hi-milan MK7320 (K) and the like.

The ionomer resin is also commercially available from DuPont Co. as those products under the trade names of Surlyn 8945 (Na), Surlyn 8940 (Na), Surlyn 9910 (Zn), Surlyn 9945 (Zn), Surlyn 7930 (Li), Surlyn 7940 (Li) and the like. The ionomer resin is also commercially available from Exxon Chemical Japan Ltd. as products under the trade names of Iotek 7010 (Zn), Iotek 8000 (Na), Iotek 7030 (Zn), Iotek 8030 (Na) and the like.

It is noted that those symbols Na, Zn K, Li, and Mg in the parentheses, which follow the trade names of the ionomer resin, represent a metal type of the neutralizing metal ions. According to the present invention, the ionomer resin used as a base resin material for the cover may be a mixture of at least two of the above ionomer resins or a mixture of at least two of the ionomer resins neutralized by a monovalent metal ion and the ionomer resins neutralized by a bivalent metal ion.

Component B of the cover composition is an ionomer resin of a ternary copolymer of an ethylene, an acrylic acid or methacrylic acid, and an acrylic acid ester or methacrylic acid ester. Preferably, the composition ratio of these three components constituting the copolymer is that the ethylene is 70 to 85% by weight, (meth)acrylic acid is 5 to 20% by weight, and (meth)acrylic acid ester is 10 to 25% by weight. The (meth)acrylic acid ester is for example a methyl (meth) acrylate, ethyl (meth)acrylate, propyl (meth)acrylate, n-butyl (meth)acrylate, isobutyl (meth)acrylate or the like. The ternary copolymer ionomer resin is commercially available from Dupont-Mitsui Polychemicals Co., Ltd. as products under the trade names of Hi-milan 1856 (Na), Hi-milan 1855 (Zn), Hi-milan AM7316 (Zn) and the like.

The ionomer resin is further commercially available from DuPont Co. as products under the trade names of Surlyn 8320 (Na), Surlyn 9320 (Zn), Surlyn 6320 (Mg) and the like.

The ionomer resin is also commercially available from Exxon Chemical Japan Ltd. as products under the trade names of Iotek 7510 (Zn), Iotek 7520 (Zn) and the like.

The ionomer resin of the ternary copolymer preferably has a shore D hardness of 30 to 55 and a flexural modulus of 10 to 100 MPa, since such a ternary copolymer having the shore D hardness and flexural modulus in these ranges exhibits an effect of enhancing the solubility between Component A and Component C.

A base resin of the cover of the present invention is produced by blending the ionomer resins of Component A and Component B as described above with Component C which is at least one type of thermoplastic elastomer containing a styrene block. The thermoplastic elastomer having the styrene block is a block copolymer having the styrene block and a butadiene block or polyisoprene block obtained from a conjugated diene compound as a comonomer. As the conjugated diene compound, one or at least two of butadiene, isoprene, 1,3-pentadiene, 2,3-dimethyl-1,3-butadiene and the like may be selected, for example, and especially butadiene, isoprene and a combination of them are preferred.

Specific examples of the thermoplastic elastomer including the styrene block are for example styrene-butadiene-styrene block copolymer (SBS), styrene-ethylene-butylene-styrene block copolymer (SEBS) corresponding to the SBS in which the double bond of the butadiene is hydrogenated, styrene-isoprene-styrene block copolymer (SIS), styrene-ethylene-propylene-styrene block copolymer (SEPS) corresponding to the SIS in which the double bond of the isoprene is hydrogenated, styrene-isoprene-butadiene-styrene block copolymer (SIBS), styrene-ethylene-ethylene-propylene-styrene block copolymer (SEEPS) corresponding to the SIBS in which the double bond of the butadiene or isoprene is hydrogenated, modified versions of these copolymers, and the like.

Content of the styrene in the copolymers SBS, SEBS, SIS and SEPS each is preferably 10 to 50% by weight and particularly 15 to 45% by weight. If the content is less than 10% by weight, the thermoplastic elastomer is too soft and thus a cut resistance is likely to decrease. If the content exceeds 50% by weight, the elastomer mixed with the ionomer resin of Component A cannot provide a sufficient softness and accordingly shot feeling and controllability deteriorate.

According to the present invention, the block copolymer SBS, SEBS, SIS and SEPS may partially contain an epoxy group.

A styrene-butadiene-styrene block copolymer (SBS) containing an epoxy group is specifically a block copolymer having polystyrenes at both ends and the intermediate layer is the polybutadiene containing the epoxy group. The double bond of the polybutadiene portion may be partially or entirely hydrogenated. A styrene-isoprene-styrene block copolymer (SIS) containing an epoxy group is specifically a block copolymer having polystyrenes at both ends and the intermediate layer is the polyisoprene containing the epoxy group. The double bond of the polyisoprene portion may be partially or entirely hydrogenated.

Preferably, content of the epoxy group in the block copolymer of the epoxidized SBS or SIS is 0.05 to 10% by weight and more preferably 0.2 to 5% by weight. If the epoxy group content is less than 0.05% by weight, the amount of reacted epoxy group and free carboxyl group in the ionomer resin decreases to cause lower dispersibility of the block copolymer having the epoxidized SBS or SIS into the ionomer resin, resulting in a possibility of damaging durability. If the epoxy group content is greater than 10% by weight, too much epoxy group and free carboxyl group in the ionomer resin react each other to cause lower flowability, resulting in difficulty in molding a ball.

The block copolymer of epoxidized SBS or SIS is commercially available from Daicel Chemical Industries Ltd. as a product under the trade name of Epofriend, for example.

The block copolymer of the SEBS or SEPS having hydroxyl groups at its ends of polymer chains is commercially available, for example, from Kuraray Co., Ltd. as a product under the trade name of Septon HG-252.

The inventors of the present invention have found that a golf ball exhibits superior physical properties of its cover and an excellent ball performance and especially maintains a high coefficient of restitution when the golf ball includes, as the thermoplastic elastomer containing the styrene block (Component C), a styrene-butadiene-styrene block copolymer (SBS), hydrogenated SBS, styrene-isoprene-styrene block copolymer (SIS), hydrogenated SIS, styrene-isoprene-butadiene-styrene block copolymer (SIBS), hydrogenated SIBS or a polymer alloy formed of a polyolefin. One of the reasons for these advantages is considered that the olefin component and the like contained in the polymer alloy contribute to the solubility of cover constituents with respect to each other. A particularly preferable polymer alloy is produced by blending as a base polymer a hydrogenated SBS block copolymer (SEBS) available from Shell Chemical Co., Ltd. (US), at the molecular level, with another polymer. Here, the another polymer is preferably a polyolefin obtained by polymerization of an olefin having the carbon number 2 to 10. This polymer is available from Mitsubishi Chemical Corporation under the trade name of RABALON.

According to the present invention, the thermoplastic elastomer including the styrene block has a JISA hardness which is 95 or less and preferably 80 or less.

The cover composition has the polymer component constituted of 10 to 80 parts by weight of Component A, 0 to 60 parts by weight of Component B, and 5 to 60 parts by weight of Component C. Components A, B and C are blended at such a ratio so that these three components have a superior solubility with respect to each other and thus can be blended at the molecular level. Accordingly a so-called polymer alloy is produced and resultant physical properties such as hardness, toughness and impact resilience are not achieved by the conventional simple polymer alloy blend. In this way, without deterioration in the rigidity and impact resilience exhibited by Component A, the cover can be made softer and thus improvements are possible of shot feeling, spin performance (controllability) and scuff resistance. According to the present invention, while Component B is not necessarily required, Component B blended with Components A and C at the ratio as described above can enhance the solubility of Components A and C. As a result, with the toughness and impact resilience maintained as they are, a softer cover can be produced and thus the spin performance and shot feeling are further improved.

Moreover, the cover composition of the present invention can be mixed with other polymer components in addition to the polymer components as discussed above. 10 parts by weight or less of these other polymer components are mixed relative to 100 parts by weight of the entire polymer components. Here, these other polymer components are for example at least one or two of polyolefin-based elastomer, polyurethane-based elastomer, and polyester-based elastomer blended with each other. The polyolefin-based elastomer is specifically available from Mitsui Chemicals, Inc. under the trade name of Milastomer M4800NW, from Sumitomo Chemical Co., Ltd. under the trade names of Sumitomo TPE3682 and 9455. The polyurethane-based elastomer is available from Kuraray Co., Ltd. under the trade names of Kuramilon 9195 and Kuramilon 9180, from BASF Polyurethane Elastomers Ltd. under the trade names of ELASTOLLAN ET880 and ET890, and the like. The polyester-based elastomer is specifically available from Du Pont-Toray Co., Ltd. under the trade names of Hytrel 4047, 4767 and 5557.

To the cover composition forming a cover according to the present invention, various types of additives may be added as required, for example, pigment, specific gravity regulating agent, dispersing agent, antioxidant, ultraviolet absorber, light stabilizer and the like.

The cover composition as described above can be used to cover any of a solid core and a thread-wound core.

The solid core may be of a single layer structure or a multi-layer structure having at least two layers. For example, a solid core is produced by mixing, per 100 parts by weight of polybutadiene, a total of 10 to 50 parts by weight of a crosslinking agent alone or of at least two types formed of $\alpha$, $\beta$-monoethylenic unsaturated carboxylic acid such as acrylic acid and methacrylic acid or metal salt thereof, trimethylol propane trimethacrylate polyfunctional monomer and the like, 10 to 30 parts by weight of a filler such as zinc oxide and barium sulfate, 0.5 to 5 parts by weight of peroxide such as dicumyl peroxide, and if necessary, 0.1 to 1 parts by weight of an antioxidant. The resultant rubber composition is heated and pressed by press crosslinking at 140 to 170° C. for 10 to 40 minutes, for example, to mold the mixture into a globular crosslinked product which usually has a diameter of 37.0 to 41.0 mm.

The thread-wound core is constituted of a center and a rubber thread layer formed by winding a rubber thread in an elongated state around the center. The center may be a solid center composed of a vulcanized product of rubber composition, or a liquid center formed by sealing liquid such as water and paste in a center cover made of vulcanized rubber. If the center is a solid center, preferably its diameter is 28 to 38 mm. If the center is a liquid center, its diameter is preferably 26 to 34 mm.

The above rubber thread is produced by vulcanizing a rubber composition produced by blending natural rubber or blend rubber of natural rubber and synthetic polyisoprene with antioxidant, vulcanization accelerator, sulfur and the like.

According to the present invention, the cover of the golf ball has a shore D hardness of 40 to 60. If the shore D hardness of the cover composition is less than 40, the cover is too soft which results in deteriorated shot feeling and scuff resistance. If the shore D hardness is greater than 60, a proper backspin rate is not achieved which leads to deteriorated controllability and shot feeling.

EXAMPLES

The present invention is hereinafter described specifically in conjunction with examples.

Examples 1–8 and Comparative Examples 1–4

Golf balls were manufactured through the following processes (1) to (3) for Examples and Comparative Examples.

(1) Production of Solid Core

A rubber composition including the components shown in Table 1 was prepared. The rubber composition was fed to a mold to fill it and then molded through vulcanization. A resultant product was a spherical solid core having a diameter of 39.0 mm. The vulcanization was performed at 142° C. for 16 minutes and then at 168° C. for 8 minutes.

TABLE 1

| components | parts by weight |
|---|---|
| polybutadiene *1 | 100 |
| zinc diacrylate | 34 |
| zinc oxide | 16 |
| antioxidant *2 | 0.5 |
| diphenyl disulfide | 0.5 |
| dicumyl peroxide | 1.1 |

*1 BR11 manufactured by JSR Corporation
*2 Yoshinox 425 manufactured by Yoshitomi Pharmaceutical Ind., Ltd.

(2) Preparation of Cover Composition

Components shown in Table 2 and Table 3 were mixed at the ratio shown therein by a two-shaft extruder of kneading type to prepare a pellet-shaped cover composition. The amounts of mixed components are indicated in Table 2 and Table 3 by parts by weight relative to 100 parts by weight of a polymer component, and details are given after Table 3 regarding those components represented by the trade names.

The extrusion was done under conditions of the screw diameter of 45 mm, the number of revolutions of the screw of 200 rpm, and screw L/D of 35, and the mixture was heated to 180 to 200° C. at the location of the die of the extruder.

(3) Production of Golf Ball

The cover composition obtained through process (2) described above was injection-molded over the solid core produced through process (1) to form a golf ball with a cover of 1.9 mm in thickness. A clear paint was applied onto the surface of the cover and accordingly golf balls each having an outer diameter of 42.8 mm were produced for Examples 1 to 6 and Comparative Examples 1 to 4. The cover compositions employed for manufacturing these golf balls are shown in Table 2 and Table 3 together with physical properties of the balls measured by the methods discussed below.

TABLE 2

| | | Examples | | | | | | | |
|---|---|---|---|---|---|---|---|---|---|
| | | 1 | 2 | 3 | 4 | 5 | 6 | 7 | 8 |
| | Composition | | | | | | | | |
| Component A | Hi-milan 1605*3 | 45 | 40 | 35 | 40 | 30 | 40 | 40 | 35 |
| | Hi-milan 1706*4 | 15 | 10 | 20 | 40 | 30 | — | — | 10 |
| Component B | Hi-milan 1855*5 | — | — | — | — | — | — | — | 25 |
| | Surlyn 6320*6 | 30 | 30 | 15 | — | — | 30 | 40 | — |
| Component C | Rabalon*7 SJ7400N | — | — | — | — | — | 30 | — | — |
| | Rabalon SRO4*8 | 10 | 20 | 30 | 20 | 40 | | — | — |
| | Septon HG-252 | — | — | — | — | — | — | 20 | 20 |
| | Epofriend A1010*10 | — | — | — | — | — | — | — | 10 |
| | Dynaron 6200P*11 | — | — | — | — | — | — | — | — |
| | titanium dioxide | 2 | 2 | 2 | 2 | 2 | 2 | 2 | 2 |
| physical properties of cover | shore D hardness | 53 | 49 | 45 | 54 | 45 | 45 | 49 | 51 |
| | flexural modulus (MPa) | 100 | 80 | 60 | 110 | 65 | 60 | 80 | 90 |
| ball performance | mass of ball (g) | 45.3 | 45.3 | 45.3 | 45.3 | 45.3 | 45.3 | 45.3 | 45.3 |
| | deformation by compression (mm) | 2.70 | 2.80 | 2.90 | 2.65 | 2.85 | 2.90 | 2.80 | 2.75 |
| | coefficient of restitution | 0.768 | 0.763 | 0.759 | 0.771 | 0.761 | 0.758 | 0.761 | 0.764 |
| | W #1 carry (yard) | 233 | 231 | 228 | 235 | 229 | 227 | 230 | 231 |
| | shot feeling | ○ | ○ | ○ | ○ | ○ | ○ | ○ | ○ |
| | controllability | ○ | ○ | ○ | ○ | ○ | ○ | ○ | ○ |
| | scuff resistance | ○ | ○ | ○ | ○ | ○ | ○ | Δ | ○ |

TABLE 3

| | | Comparative Examples | | | |
|---|---|---|---|---|---|
| | | 1 | 2 | 3 | 4 |
| composition | | | | | |
| Component A | Hi-milan *3 1605 | 50 | 50 | 25 | 40 |
| | Hi-milan *4 1706 | 50 | — | — | 10 |
| Component B | Hi-milan *5 1855 | — | — | — | — |
| | Surlyn 6320 *6 | — | 50 | 75 | 35 |
| Component C | Rabalon *7 SJ7400N | — | — | — | — |
| | Rabalon *8 SR04 | — | — | — | — |
| | Septon HG- *9 252 | — | — | — | — |
| | Epofriend *10 A1010 | — | — | — | — |
| | Dynaron *11 6200P | — | — | — | 15 |
| | titanium dioxide | 2 | 2 | 2 | 2 |
| physical properties of cover | shore D hardness | 64 | 53 | 45 | 51 |
| | flexural modulus (MPa) | 340 | 100 | 55 | 95 |
| ball performance | mass of ball (g) | 45.3 | 45.3 | 45.3 | 45.3 |
| | deformation by compression (mm) | 2.55 | 2.75 | 2.90 | 2.75 |
| | coefficient of restitution | 0.774 | 0.754 | 0.745 | 0.755 |
| | W#1 carry (yard) | 237 | 224 | 221 | 224 |
| | shot feeling | X | ○ | ○ | ○ |
| | controllability | X | Δ | ○ | ○ |
| | scuff resistance | ○ | Δ | Δ | X |

*3 Hi-milan 1605: manufactured by DuPont-Mitsui Polychemicals Co., Ltd., Na-neutralized ethylene-methacrylic acid copolymer ionomer with shore D hardness of 61 and flexural modulus of 295 MPa

*4 Hi-milan 1706: manufactured by DuPont-Mitsui Polychemicals Co., Ltd., Zn-neutralized ethylene-methacrylic acid copolymer ionomer with shore D hardness of 60 and flexural modulus of 270 MPa

*5 Hi-milan 1855: manufactured by DuPont-Mitsui Polychemicals Co., Ltd., Zn-neutralized ethylene-methacrylic acid-i-butyl acrylate ternary copolymer ionomer with shore D hardness of 54 and flexural modulus of 87 MPa

*6 Surlyn 6320: manufactured by DuPont Co., Mg-neutralized ethylene-methacrylic acid-n-butyl acrylate ternary copolymer ionomer with shore D hardness of 44 and flexural modulus of 35 MPa

*7 Rabalon SJ7400N: manufactured by Mitsubishi Chemical Corporation, SEBS-based thermoplastic elastomer with shore A hardness of 75

*8 Rabalon SR04: manufactured by Mitsubishi Chemical Corporation, SEBS-based thermoplastic elastomer with shore A hardness of 40

*9 Septon HG-252 : manufactured by Kuraray Co., Ltd., hydrogenated SIBS with OH group added thereto with shore A hardness of 80

*10 Epofriend A1010: manufactured by Daicel Chemical Industries Ltd., epoxidized SBS with shore A hardness of 67

*11 DYNARON 6200P: manufactured by JSR Corporation, hydrogenated polybutadiene (C-EB-C) with shore A hardness of 66, "C" in C-EB-C representing crystalline polyethylene block and C-EB-C representing polyethylene crystal-ethylene-butylene-polyethylene crystal According to the present invention, performances of golf balls were evaluated as follows.

(1) Shore D Hardness 2-mm thick sheet produced with thermo press from each cover composition were saved for two weeks at 23° C., and thereafter at least three of the sheets were overlaid on each other and measurements were taken by a method defined by ASTM-D2240-68.

(2) Flexural Modulus 2-mm thick thermo press sheets produced from each cover composition were saved for two weeks at 23° C., and thereafter measurements were taken by a method defined by JISK7106.

(3) Deformation by Compression Loads were imposed on a golf ball from an initial load of 10 kgf to a final load of 130 kgf and a deformation generated during this period was measured, the measurements represented in mm.

(4) Coefficient of restitution

A golf ball was collided with a cylindrical body of 200 g in weight made of aluminum at a speed of 45 m/s. The speeds of the cylindrical body and the golf ball before and after the collision were measured. From these measurements and weights of the cylindrical body and ball, a coefficient of restitution was calculated for each golf ball.

(5) Flight Performance

A W#1 driver formed of a metal head was attached to a swing robot manufactured by True-Temper to hit each golf ball at a head speed of 45 m/sec. The total carry ending with the point where the ball stops was then measured. An average of five measurements was determined as the total carry for each golf ball.

(6) Shot Feeling

Golf balls were actually hit by 10 golfers using W#1 drivers formed of metal heads. The shot feeling was evaluated on the basis of the following standard and the rating taken by a majority of the golfers was chosen as an evaluation of a golf ball.

○: good, less impact with certain rebound

Δ: ordinary

×: great impact or felt heavy (7) Controllability

Golf balls were actually hit by 10 golfers using pitching wedges to evaluate the balls on the basis of the following standard, and the rating taken by a majority of the golfers was chosen as an evaluation of a golf ball.

○: superior controllability, easy to apply a spin

Δ: ordinary

×: inferior controllability, slippery, difficult to apply a spin (8) Scuff Resistance A commercially available pitching wedge was attached to a robot machine to hit two points on a golf ball at a head speed of 36 m/s once for each point. The hit two points were observed to make an evaluation in three grades.

○: inconspicuous minor abrasions left on the ball surface

Δ: apparent abrasions left on the ball surface and a slight fuzz observed

×: ball surface considerably chipped off and a noticeable fuzz observed

Examples 1 to 3 and 6 to 8 each are a mixture of Components A, B and C and excellent in impact resilience (coefficient of restitution), shot feeling, controllability and scuff resistance as a whole. It is noted that Examples 1, 2 and 3 contain Component C mixed therein with its amount increasing in the order of Examples 1, 2, 3 and accordingly the shore D hardness and flexural modulus of the cover decrease and the coefficient of restitution also decreases accordingly.

Examples 4 and 5 do not contain Component B mixed therein and the coefficient of restitution is kept relatively high. Example 6 contains Rabalon SJ7400N as Component C, Example 7 contains Septon HG-252 as Component C, and Example 8 contains Epofriend A1010 as Component C. From Tables 2 and 3, it is understood that various characteristics of the golf balls are excellent as a whole.

Comparative Example 1 contains only Component A in the cover and Comparative Examples 2 to 4 each are a mixture of Component A and Component B. These Comparative Examples are generally inferior in terms of shot feeling, controllability and scuff resistance.

As heretofore discussed, according to the present invention, a cover composition includes a polymer component formed by blending an ethylene-(meth)acrylic acid copolymer ionomer resin (Component A) with a thermoplastic elastomer containing a styrene block (Component C) at a specific ratio and further with an acrylic acid-(meth) acrylic acid-(meth)acrylic acid ester ternary copolymer ionomer resin (Component B) as required. Accordingly, these components can be mixed at the molecular level and thus basic cover characteristics are different from and superior to those of conventional mixtures. Consequently, a cover of that cover composition can be used for a golf ball providing excellent shot feeling, impact resilience, controllability and scuff resistance as a whole.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball including a core and a cover surrounding said core, said cover formed of a cover composition containing a polymer component including 10 to 80 parts by weight of an ethylene-(meth)acrylic acid copolymer-based ionomer resin (Component A), greater than 0 and up to 60 parts by weight of an ethylene-(meth) acrylic acid-(meth) acrylic acid ester ternary copolymer-based ionomer resin (Component B), and 5 to 60 parts by weight of a thermoplastic elastomer which comprises a polymer alloy of a polymer containing a styrene block and a polyolefin (Component C), said cover composition having a shore D hardness of 40 to 60.

2. The golf ball according to claim 1, wherein said polymer containing the styrene block is a styrene-butadiene-styrene block copolymer (SBS), styrene-isoprene-styrene block copolymer (SIS), styrene-isoprene-butadiene-styrene block copolymer (SIBS), or hydrogenated copolymers of respective copolymers.

3. The golf ball according to claim 1, wherein said polymer containing the styrene block is a styrene-ethylene-butadiene-styrene block copolymer (SEBS).

4. The golf ball according to claim 1, wherein said thermoplastic elastomer has a shore A hardness of at most 95.

5. The golf ball of claim 1, wherein component A has a shore D hardness of 55 to 70 and a flexural modulus of 200 to 500 MPa.

6. The golf ball of claim 1, wherein component B has a shore D hardness of 30 to 55 and a flexural modulus of 10 to 100 MPa.

7. The golf ball of claim 1, wherein component A has a composition ratio of ethylene and the acrylic acid and or methacrylic acid constituting the copolymer of 70 to 95% by weight ethylene and 5 to 30% by weight of the acrylic acid or methacrylic acid.

8. The golf ball of claim 1, wherein component B has a composition ratio of ethylene, an acrylic acid or methacrylic acid, and an acrylic acid ester of methacrylic acid ester constituting the terpolymer of 70 to 85% by weight ethylene, 5 to 20% by weight of acrylic or methacrylic acid and 10 to 25% by weight of acrylic or methacrylic acid ester.

9. The golf ball of claim 1, wherein the styrene in the copolymer is 10 to 50% by weight.

10. The golf ball of claim 1, wherein component B is present in an amount of 15 parts to 40 parts by weight.

11. The golf ball of claim 10, wherein component B has a Shore D hardness of 30 to 55 and a flexural modulus of 10 to 100 Mpa.

* * * * *